United States Patent [19]

Heaps, Jr. et al.

[11] Patent Number: 4,919,306

[45] Date of Patent: Apr. 24, 1990

[54] CONTAINER FOR FLUENT MATERIAL INCLUDING A RING-LIKE HOLDER FOR A BAG

[75] Inventors: Harry D. Heaps, Jr.; Charles E. Boy, both of Bala-Cynwyd, Pa.

[73] Assignee: Connelly Containers, Inc., Bala-Cynwyd, Pa.

[21] Appl. No.: 332,375

[22] Filed: Mar. 31, 1989

Related U.S. Application Data

[63] Continuation of Ser. No. 149,920, Jan. 25, 1988, abandoned, which is a continuation-in-part of Ser. No. 944,502, Dec. 17, 1986, Pat. No. 4,771,917.

[51] Int. Cl.[5] ..... B65D 37/00

[52] U.S. Cl. ..... 222/105; 220/462; 222/183; 222/528; 251/4; 383/24; 383/67

[58] Field of Search ..... 222/105, 107, 131, 181, 222/183, 185, 386.5, 527, 528, 538, 540; 220/464, 465, 461–463; 383/24, 67; 251/4

[56] References Cited

U.S. PATENT DOCUMENTS

| | | | |
|---|---|---|---|
| Re. 32,308 | 12/1986 | Nattrass | 383/24 |
| 662,955 | 12/1900 | McClelland | 251/4 |
| 1,181,506 | 5/1916 | Cunningham | 220/403 |
| 1,336,891 | 4/1920 | Corbin | 251/4 |
| 2,145,613 | 1/1939 | Shenk et al. . | |
| 2,654,892 | 10/1953 | Szabo | 220/404 |
| 2,861,718 | 11/1958 | Winzen | 222/185 X |
| 2,946,494 | 7/1960 | Kuss | 220/465 |
| 3,090,526 | 5/1963 | Hamilton et al. | 220/465 |
| 3,190,537 | 6/1965 | Meinecke et al. | 222/183 X |
| 3,206,094 | 9/1965 | Humphrey et al. . | |
| 3,223,117 | 12/1965 | Curie et al. | 222/183 X |
| 3,225,002 | 12/1965 | Walker | 220/465 |
| 3,300,102 | 1/1967 | Budzich | 222/386.5 |
| 3,433,400 | 3/1969 | Hawkins | 222/185 X |
| 3,779,419 | 12/1973 | Heitz | 220/404 |
| 3,965,953 | 6/1976 | Becker et al. | 383/24 X |
| 4,062,475 | 12/1977 | Haris et al. | 222/386.5 X |
| 4,147,051 | 11/1979 | Edwards et al. | 222/105 |
| 4,167,235 | 9/1979 | Green | 222/105 |
| 4,185,758 | 1/1980 | Giggard | 222/386.5 |
| 4,265,373 | 5/1981 | Stoody | 222/386.5 X |
| 4,306,668 | 12/1981 | Love | 222/183 X |
| 4,322,018 | 3/1982 | Rutter | 222/83 |
| 4,346,743 | 8/1982 | Miller | 222/386.5 X |
| 4,356,853 | 11/1982 | Sekiguchi | 150/1 |
| 4,375,864 | 3/1983 | Savage | 222/81 |
| 4,426,015 | 1/1984 | Preston et al. | 220/403 |
| 4,461,402 | 7/1984 | Fell et al. | 222/105 |
| 4,516,692 | 5/1985 | Croley | 222/105 |
| 4,524,457 | 6/1985 | Marino | 383/17 |
| 4,549,673 | 10/1985 | Kupersmit | 220/465 |
| 4,585,143 | 5/1986 | Fremow et al. | 220/462 |
| 4,597,102 | 6/1986 | Nattrass | 222/105 |

FOREIGN PATENT DOCUMENTS

| | | | |
|---|---|---|---|
| 3016466 | 11/1980 | Fed. Rep. of Germany | 220/403 |

*Primary Examiner*—Kevin P. Shaver

*Attorney, Agent, or Firm*—Mason, Fenwick & Lawrence

[57] ABSTRACT

A container of corrugated paper board has a bag for holding liquid. The bag is supported by a plate which is adjacent the top of the container, the plate having slots through which are passed suspension loops attached to the top of the bag; keepers pass through the loops to hold them and the bag. A screw threaded filling fitting is provided in the bag. In an alternate embodiment, the top of the bag is rolled in a composite ring formed of metal and fiber board, the ring resting on the plate, and the bag extending into the container through a hole in the plate smaller than the ring; the suspension loops and keepers are also provided on this bag. A flexible discharge spout is held closed by a compression block and a strap, and is attached to a flap of a bottom plate by a severable band.

38 Claims, 6 Drawing Sheets

CONTAINER FOR FLUENT MATERIAL INCLUDING A RING-LIKE HOLDER FOR A BAG

This application is a continuation of application Ser. No. 149,920 filed Jan. 25, 1988, now abandoned, which is a continuation-in-part application of application Ser. No. 944,052 filed Dec. 17, 1986, now U.S. Pat. No. 4,771,917 issued Sept. 20, 1988.

BACKGROUND OF THE INVENTION

The present invention relates to a container of fluent material.

Containers for fluent material generally have an outer load bearing shell, frequently made of corrugated paper board such as double wall board or triple wall board, the additional layers provided by these multi-wall boards providing additional strength. The outer corrugated board container has within it a bag which is made of flexible material impervious to the liquid or other fluent material to be contained within the container. These bags are typically of a suitable plastic, such as polyvinyl chloride. Containers of this type for shipping large quantities and weights of fluent material are typically provided with a filler opening or fitting in the top of the liner bag, and the liner bag is usually provided with a discharge fitting near its bottom, for the discharge of the fluent material from within the liner bag of the container.

Examples of containers of the above type for shipping large weights of fluent material include Croley U.S. Pat. No. 4,516,692, Kupersmit U.S. Pat. No. 4,549,673, and Fremow et al U.S. Pat. No. 4,585,143.

A number of containers have been provided in which there has been support for the bag at the upper part thereof. Preston et al U.S. Pat. No. 4,426,015 discloses a container with an outer protective shell and a bag, and a member which engages posts within the container to which a filling spout in the center part of the top of the bag is attached for holding the top of the liner near the top of the container during filling. Prior to the attachment of the filling opening, loops at the upper corners of the liner are passed at the corners of the container to the outside of the container and held by adhesive tape. Other bags, not within outer shells, have been provided with loops at their upper ends, generally used for lifting the bags; see Green U.S. Pat. No. 4,167,235, Sekiguchi U.S. Pat. No. 4,356,853, Fell et al U.S. Pat. No. 4,461,502, Marino U.S. Pat. No. 4,524,457, and Natrass U.S. Pat. No. RE. 32,308. These suspension loops have been placed at the periphery of the bags.

The provision of holding elements or suspension elements at the edges of the bag do not provide support for the top of the bag in a uniform manner during filling or transport of the filled container.

Containers of the above type have been provided only with relatively small diameter filling fittings to which the liner bag was attached, as by adhesion or welding. Examples include Kuss U.S. Pat. No. 2,946,494, Walker U.S. Pat. No. 3,226,002, Edwards et al U.S. Pat. No. 4,174,051, and Preston et al U.S. Pat. No. 4,426,015. Other disclosures have provided no fitting at all at the top of the liner or bag, such as in Croley U.S. Pat. No. 4,516,692. In the former type, the rapidity of filling, particularly with materials of a paste-like constituency such as tomato sauce, required an unsatisfactorily long time. In the type in which no fitting was provided on the liner bag, special arrangements were required to associated and hold a filling hose to the bag.

There have been a number of proposals in the prior art for holding a liner bag of thin plastic material to the top edge of a receptacle such as a garbage can. Heitz U.S. Pat. No. 3,779,419 provides a number of embodiments for this purpose, there generally being provided an annular insert into the top of the garbage can which clamps the mouth of the liner bag to prevent it from falling into the garbage can. These annular inserts were either fitted into the mouth of the garbage container, or into the upper edge of the garbage container, where a molded plastic can was provided with a groove or recess to releasably receive the annular holding element. This construction was provided so that the holding element can be readily removed, to permit the replacement of liner bags in the garbage can.

Another disclosure of apparatus for holding a liner within a container is provided by Shenk et al U.S. Pat. No. 2,145,613, in which the top of a barrel is provided with a bead, and a ring has the mouth of a bag passed between it and the bead: a top is held in position against the bead by an expandable band, the parts being disassembled for replacement of the bag.

The discharge fittings provided in the prior art were typically of hard plastic material, often being tubular with a flange for connection to the liner bag and provided with other flanges for association with the container. Powell U.S. Pat. No. 3,363,807 is exemplary of such constructions. Rutter U.S. Pat. No. 4,322,018 provides a construction of this general nature in which a piercing spout is used, inserted in a rigid fitting and making its own opening in the wall of the bag. Hamilton et al U.S. Pat. No. 3,090,526 discloses a fitting having a flexible spout connected to it and included in the package. Savage U.S. Pat. No. 4,375,864 provides a variation of a rigid spout in which a plug is forced inwardly by a hollow probe inserted into the fitting. These known fittings require either puncturing of the liner bag, which is an often difficult and unreliable operation, or they need a valve, which is subject to leakage particularly under the pressures generated with high capacity containers.

Also known is a construction in which a drain spigot of generally tubular construction has a flexible plastic hose fitted over it, the hose being double-reversely or folded into an "S" shape, and held in the folded position by a clamp using screw threaded members. This construction is not adaptable to being enclosed within the container, and may require a tool such as pliers to effect the release of the clamp.

SUMMARY OF THE INVENTION

A container is provided made of corrugated paper board of a size and strength to contain a large quantity, such as 300 gallons, of liquid or fluent material, there being provided a bag within the corrugated board container. The container has a generally horizontal top, and vertical walls, and the bag has a generally horizontal top, and depending walls, which are of generally the same size and shape as the interior of the container. The bag is provided with a central opening, and with plural supporting loops located on the top, outwardly of the opening, the supporting loops being generally uniformly distributed, and being inwardly of the edges of the top. A supporting beam, in the form of a plate of corrugated board, is supported in the container adjacent its top, the plate having a central opening. The plate is also provided with a plurality of slots between the central opening and the edges, the supporting loops of the bag extending through these slots, and being held by keepers which are larger than the slots in the plate. This supporting construction for the liner bag serves to prevent twisting of the liner bag, or other distortion during filling of it with fluent material after it has been placed within the container.

The filling opening of the liner may be a conventional flanged and threaded fitting, with a threaded cap, or may be a composite ring comprised of a transversely configured metal ring and a configured and mating fiber ring, with the mouth of the bag laminated between them when they are formed in conventional manner. The diameter of the composite ring is larger than the diameter of the central opening in the plate, the diameter of the plate thereby defining the size of the filling opening of the bag: by this construction, an unusually large diameter opening is provided together with a supporting construction for the bag.

The bag is provided with a discharge spout at the bottom which is of flexible material, such as plastic, the outer end of the discharge spout having a threaded fitting and closure cap attached to it. Flow through the spout is prevented by the provision of reverse folds, and a compression block urged into engagement with the folded spout by a strap: the compression block has an arcuate face engaging the spout, and has a notch opposite the arcuate space to receive a knife for cutting the strap.

The container is provided with an interior bottom plate to which the bottom of the bag is attached, the bottom plate having a flap extending from it and lying generally along and inwardly of a wall of the container. The flap has an opening through which the spout extends, and the flap is slit downwardly from its upper edge, a pair of tabs extending from the slit to fold lines, the tabs being bent at angles to the flap in order to provide a recess for the spout. The spout is attached to the flap by an elastic band which passes through slits in the flap extending downwardly from the upper edge thereof, and passing around the top of the spout and the central portion of the flap. Opposite the spout, the wall of the container and a liner within it are provided with a vertically extending opening through which the spout may be moved to the discharge position, which is generally horizontal. An external flap, extending upwardly from the bottom of the container, is located over the opening for the spout in the container wall, being held in position by a metal band, which is cut to allow the exterior flap to be moved, to provide access to the spout.

Among the objects of the present invention are the provision of a container for fluent material having a liner which is supported to avoid creases by twisting while the liner is being filled, to thereby avoid creases, which may cause leaks, and to avoid a decrease in the quantity of material which may be introduced into the liner.

Another object of the present invention is to provide a container and bag which may be rapidly and conveniently filled, through a relatively wide filling opening.

Yet another object of the present invention is the provision of a container and bag having a holder for the mouth of the bag for both holding the mouth open during filling and for supporting the weight of the bag and the material therein, at least in part.

Other objects and many of the attendant advantages of the present invention will be readily understood from the following specification, claims and drawings.

DESCRIPTION OF THE PREFERRED EMBODIMENTS

Figure 1:
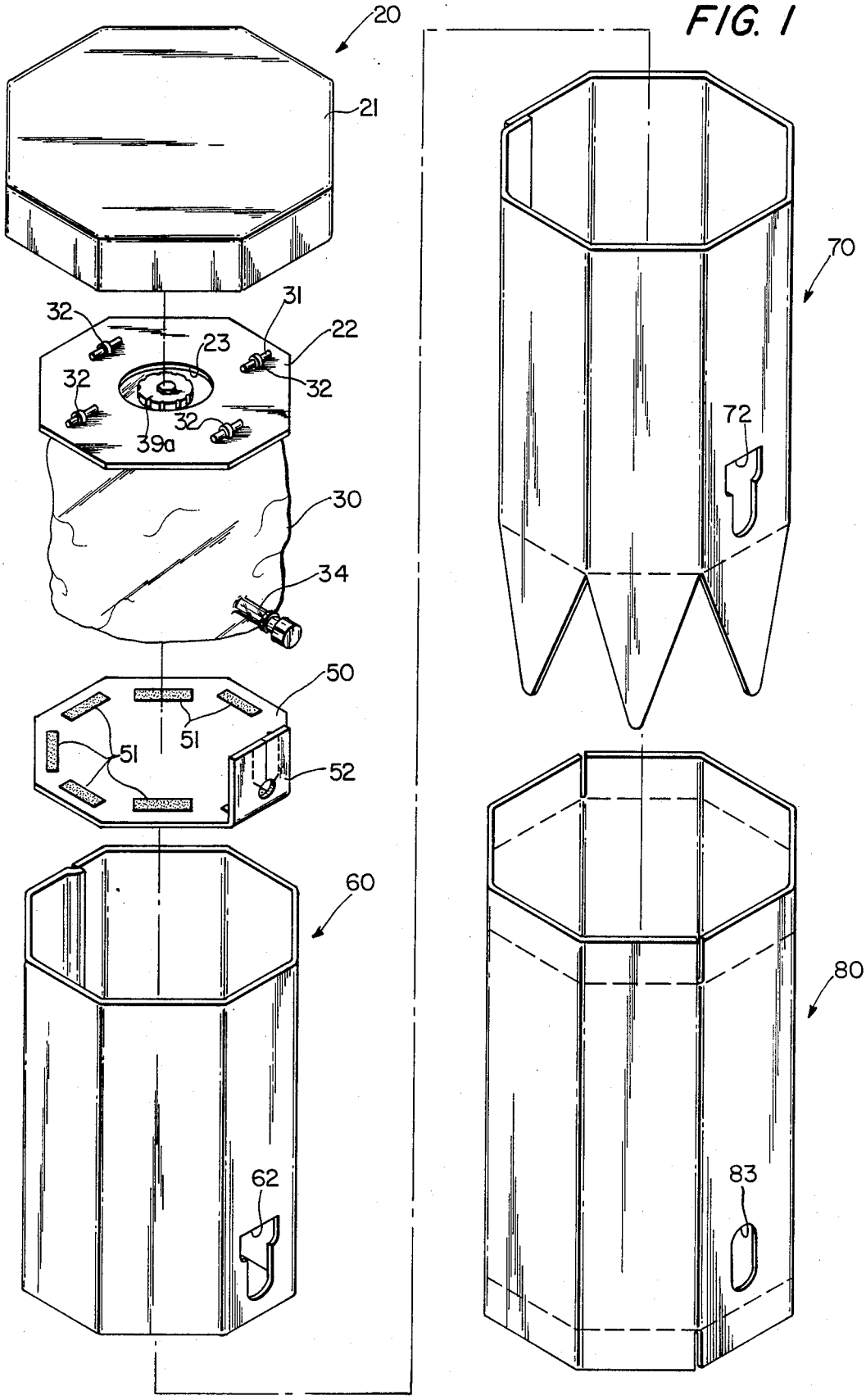
FIG. 1 is an exploded perspective view of a container for fluent material in accordance with the present invention.

Referring now to the drawings, wherein like or corresponding reference numerals are used to designate like or corresponding parts throughout the several views, there is shown in FIG. 1 an exploded perspective view of the parts of a container 20 in accordance with the present invention. These parts include an octagonal, skirted closure cap 21, a top plate 22, a bag 30, a bottom plate 50, an inner liner 60, an outer liner 70, and a shell 80.

The cap 21, top plate 22, bottom plate 50, liners 60 and 70, and shell 80 are made of multi-wall corrugated paper board, such as double wall board or triple wall board. Such multi-wall corrugated paper board is relatively strong, capable of sustaining heavy load forces, and is stiff, resistant to flexing or bending unless scored. The top plate 22 is octagonal, and has a central opening 23 and four slits through which extend suspension loops 32 of the bag 30. The suspension loops 32 and the slots through which they extend are substantially evenly distributed about the opening 23. The bag 30 has a spout 34 of flexible plastic material extending therefrom. Bottom plate 50 is octagonal and has a plurality of adhesive areas or double faced adhesive tapes 51 adjacent the perimeter thereof. There is also provided on the bottom place 50 a flap 52.

The inner liner 60 is octagonal and is made up of a series of rectangular panels. The outer liner 70 is also octagonal, and is made up of a series of rectangular panels having generally triangular flaps at their lower ends. Similarly, the outer shell 80 is octagonal and is made up, in part, of a plurality of rectangular panels.

Figure 2:
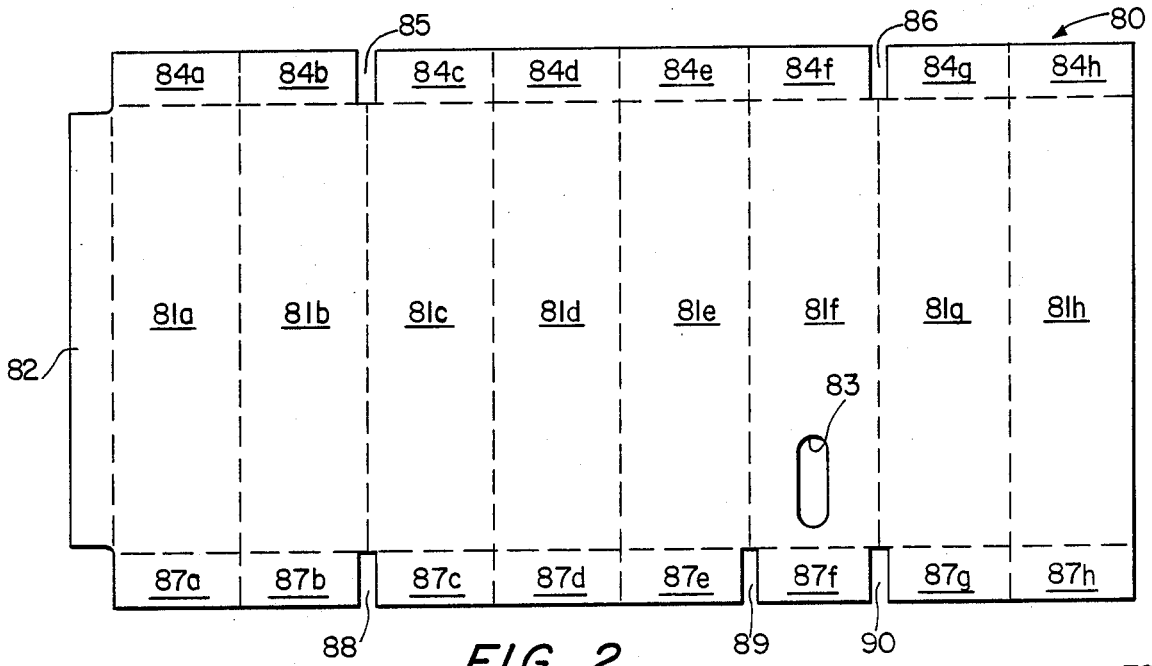
FIG. 2 is a plan view of a blank for forming the shell of the container.
Figure 3:
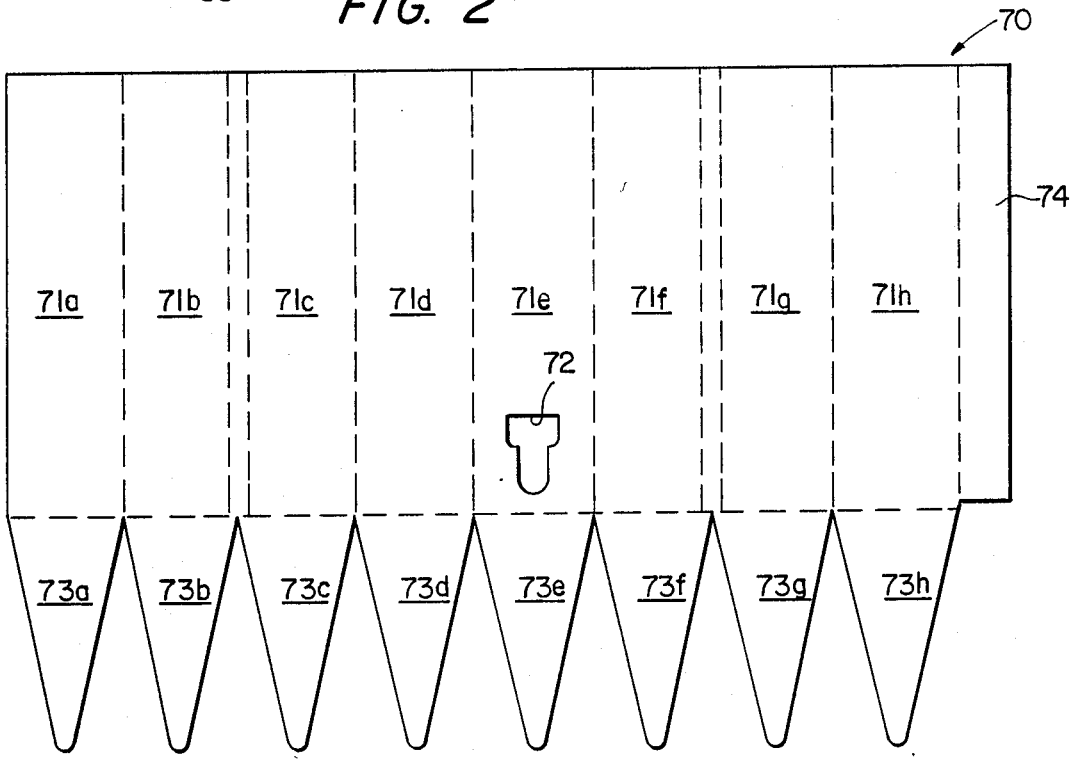
FIG. 3 is a plan view of a blank for forming one layer of a liner for the container.

FIG. 2 shows the blank for the outer shell 80, and comprises eight serially connected rectangular panels 81*a*–81*h*, separated by score lines. A flap 82 is adjacent to the panel 81*a*. The panel 81*f* has an opening 83 near the bottom thereof, of generally elongate rectangular configuration. Top flaps 84*a*–84*h* are provided on the panels 81*a*–81*h*, respectively, adjacent top flaps being connected by fold lines, except that top flaps 84*b* and 84*c* are separated by a slot 85 and top flaps 84*f* and 84*g* are separated by a slot 86. Bottom flaps 87*a*–87*h* are provided on the panels 81*a*–81*h*, and there are provided slots 88, 89 and 90, the latter two separating bottom flap 87*f* from the adjacent bottom flaps 87*e* and 87*g* so that only bottom flap 87*f* can be moved after the container is erected.

Figure 4:
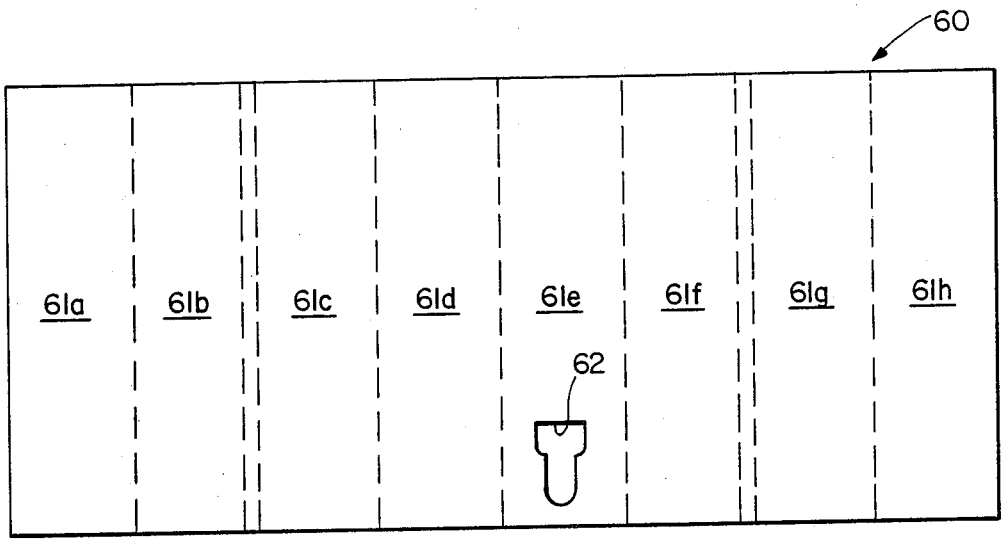
FIG. 4 is a plan view of a blank for forming another layer of the liner of the container.

The outer liner 70 is comprised of eight rectangular panels 71*a*–71*h* which are separated by score lines. Double score lines may be used at spaced locations, as shown, such as those between panels 71*b* and 71*c*, 71*f* and 71*g*. An opening 72 is provided in the panel 71*e* near the bottom thereof, and, as will be understood, will be in registry with the opening 83. Generally triangular bottom flaps 73*a*–73*h* are connected by fold lines to the bottoms of the panels 71*a*–71*h*, respectively. A flap 74 is joined to the panel 71*h*, to provide a manufacturer's joint. The inner liner 60, as shown in FIG. 4, comprises the rectangular panels 61*a*–61*h*, separated by fold lines, panel 61*e* having an opening 61 at the bottom thereof of substantially the same size and shape as the opening 72 and the panel 71*e*.

Figure 5:
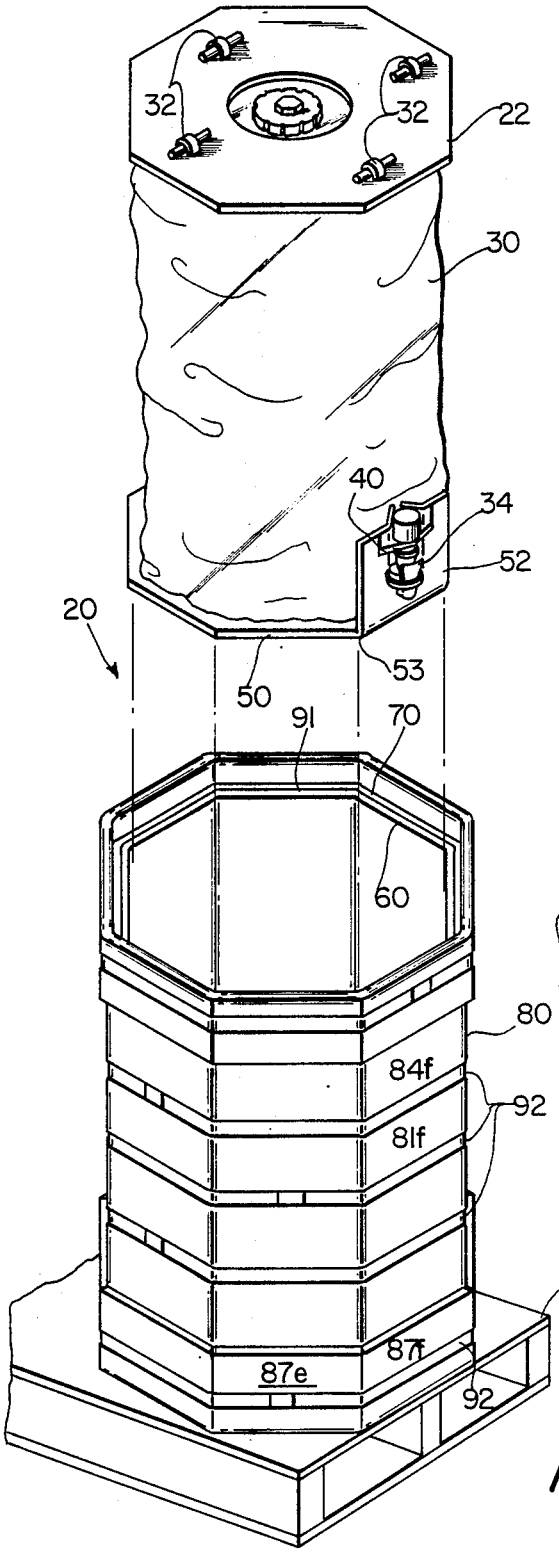
FIG. 5 is a perspective view of an assembled container, without a top and of a sub-assembly of a bag and components associated with it.

Referring now to FIG. 5, there is shown a container made from the blanks 60, 70, and 80, the blank 80 being formed into an octagonal outer shell having the bottom flaps 87*a*–87*f* turned upwardly so as to extend along the exterior surfaces of the panels 81*a*–81*h*. A conventional strap 92 encircles the bottom flaps, and other straps 92 encircle the outer shell 80. At the top of the outer shell 80, the top flaps 84*a*–84*h* are seen extending downwardly along the outer surface of the panels 81*a*–81*h*.

Within the outer shell 80, there may be seen the inner liner 60 and the outer liner 70. The flaps 73*a*–73*h* of the outer liner 70 will have been folded inwardly to form the bottom of the container 20, and the inner liner 60 will have been secured by adhesive to the outer liner 70 before insertion into the outer shell 80 with the panel 61*e* adjacent to the panel 71*e*, so that the openings 62 and 72 are in registry. The liners will have been inserted into the outer shell 80 so that the openings 62 and 72 are in registry with the opening 83 in the panel 81*f* of outer shell 80. The liner 60 and 70 and outer shell 80 are shown in position on a pallet P. As shown in FIG. 5, the liners 60 and 70 have a lesser height than the height of the outer shell 80, so that together the tops of these liners form a ledge 91 provided by the top edges of the panels 61*a*–61*h* and 71*a*–71*h*. Thus, the outer shell 80 extends above the level of ledge 91.

Also shown in FIG. 5 is the bag 30, which has been assembled to the bottom plate 50 by the adhesive areas or tapes 51 (see FIG. 1). Spout 34 will have been passed through an opening in the flap 52, in a manner hereinbelow described, and the top plate 22 will have been assembled to the bag 30 by the passing of the loops 32 through slots in the top plate 22, in a manner to be described hereinbelow.

Figure 6A:
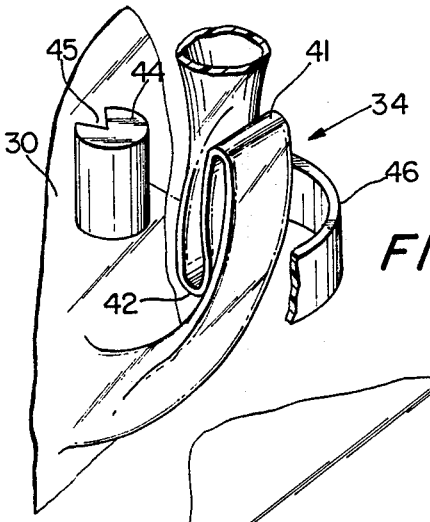
FIG. 6A is a perspective view of the spout and related parts shown in FIG. 6.
Figure 6:
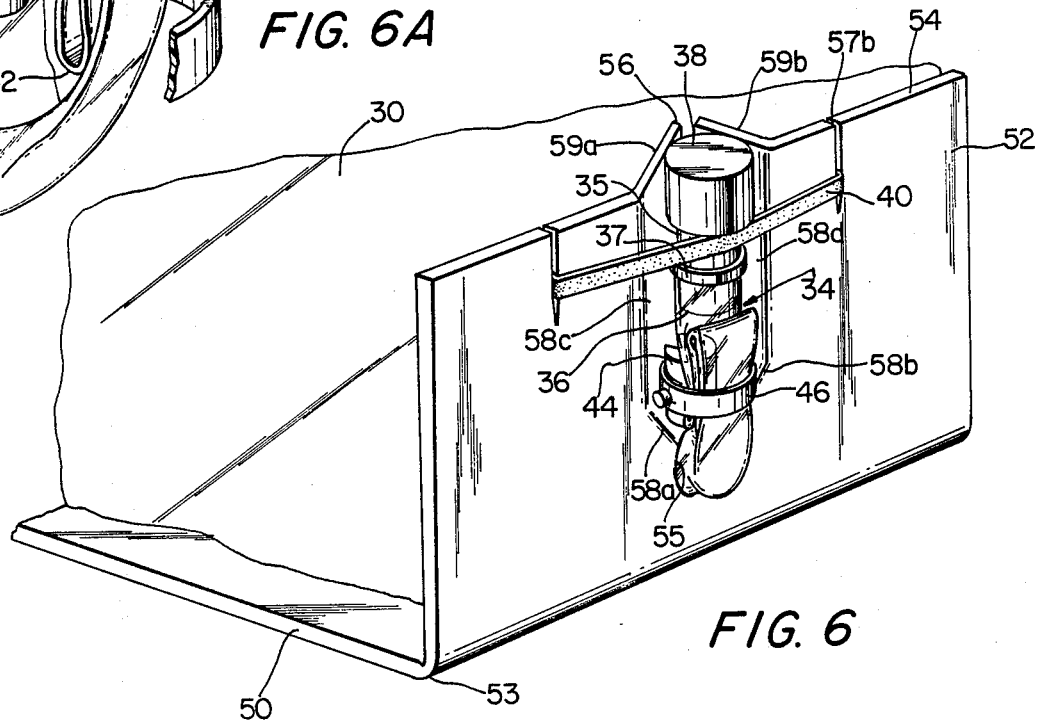
FIG. 6 is an enlarged view of the attachment of the bag and the spout of the bag to a bottom plate and flap.

In FIG. 6 there is shown an enlarged view, with parts removed, of the lower part of the bag 30, resting on and adhered to the bottom plate 50. The flap 52 is generally rectangular, having a fold line 53 at its juncture with the bottom plate 50 and a generally horizontal top edge 54. An opening 55 is provided adjacent the bottom thereof, and a slit 56 extends downwardly to the opening 55. Laterally spaced from the slit 56 are a pair of slits 57*a*, 57*b* extending downwardly from the top edge 54. A pair of angular slits 58*a* and 58*b* extend from the opening 55 to partially define tabs 59*a* and 59*b* which are displaced from the plane of the flap 52 in order to provide a recess for the spout 34. The tabs 59*a* and 59*b* are folded outwardly along fold lines 58*c* and 58*d* which extend upwardly from the slits 58*a* and 58*b* to the top edge 54.

The spout 34 is of a relatively thin, flexible plastic material, and as shown, is transparent. Spout 34 is generally tubular in cross-section and has secured to its end portion a fitting 35 of hard, tubular plastic, the end 36 of which may be seen within the tubular end portion of the spout 4. The fitting 35 of hard, tubular plastic, the end 36 of which may be seen within the tubular end portion of the spout 34. The fitting 35 is secured to the spout 34 by a strap 37. An internally threaded end cap 38 is threaded onto the end of the fitting 35. As shown in FIG. 6, an elastic band 40 is used to attach the spout 34 to the flap 52, by being passed downwardly through the slits 57*a* and 57*b*, a part of elastic band 40 passing outwardly of the spout 34, and another part passing on the inward side of the flap 52.

To provide a closure for the spout 34 during filling, storage and shipment, there is shown in FIG. 6A a portion of the spout 34 intermediate the attachment thereof to the bag 30 and the fitting 35 (not shown). The spout 34 is provided with two reverse folds 41 and 42, providing three intermediate portions of the spout 34 which are contiguous layers. A compression block 44 is provided, which is generally in the form of a cylindrical block having a notch 45 therein, the notch 45 extending longitudinally of the compression block 44. A portion of the cylindrical surface of the block or element 44 engages the innermost of the layers of the spout 34, and is held against it by a strap 46, shown broken away in FIG. 6A, but shown in its encircling configuration in FIG. 6. The strap 46 serves to clamp the spout 34 in the dual reverse folded configuration shown in FIG. 6A and to clamp the compression block 44 against the spout 34. Strap 46 has at one end an enlargement with a passage through which the other end may be drawn and held in position: it is commercially available and a suitable construction is shown in U.S. Pat. No. 3,186,047.

Referring again to FIG. 5, the spout 34 will be configured as shown in FIG. 6 and FIG. 6A, with the compression block 44 in position and held by the strap 46, spout 34 extending through the opening 55 and being attached to the flap 52 by the elastic band 40. The assemblage of the bag 30, top plate 22 and bottom plate 50 will be positioned over the opening provided by the container formed of the liners 60 and 70 and outer shell 80, and the bottom plate 50 will be positioned so that the flap 52 is in alignment with the panel 61*e* of the inner liner 60 with the opening 62, and since the dimensions of the bottom plate 50 and flap 52 are somewhat smaller than the dimensions of the inner liner 60, the bottom plate 50 will pass downwardly within the inner liner 60, the resiliency of the paper board material at the fold line 53 urging the flap 52 to rotate in a clockwise direction as shown in FIG. 5, to thereby cause the spout 34 to enter into the openings 62, 72 and 83 and to lodge therein in a manner to be hereinafter described. The top plate 22 is larger than the bottom late 50, being of a size to permit it to pass inwardly of the outer shell 80, but not to pass the ledge 91: thus, the top plate 22 will rest on or be held by the ledge 91, the bag 30 being, in this configuration, substantially fully extended.

Figure 7:
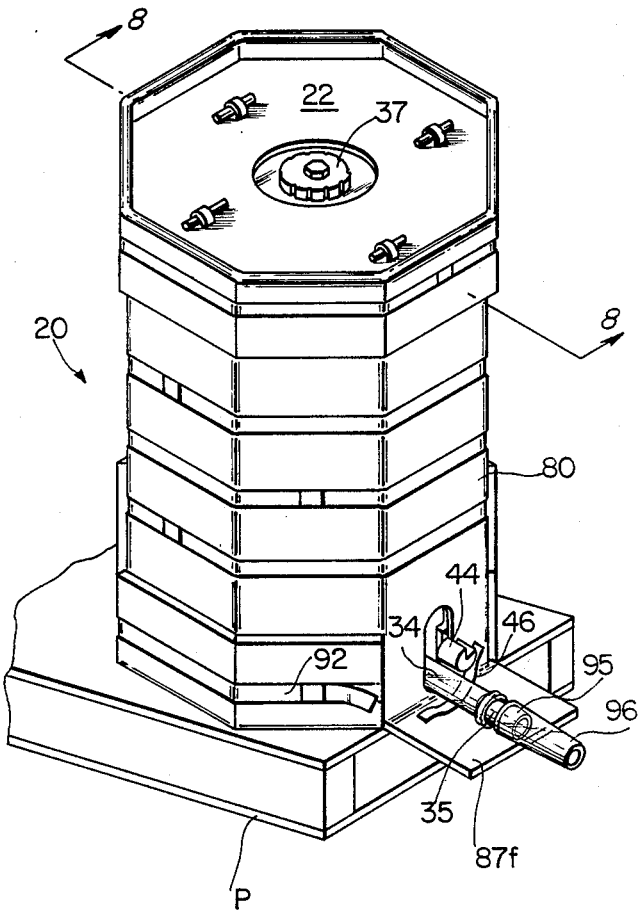
FIG. 7 is a perspective view of a filled container, with the spout thereof extended in preparation for discharging of the contents of the container.

FIG. 7 shows the container 20, but without the cap 21, after it has been delivered to its destination, seated on the pallet P on which it was erected and filled. There is shown the octagonal top plate 22, with its outer edges adjoining the inner surface of shell 80 and there is also shown the flap 87*f* which has been rotated to a substantially horizontal position, following the severing of the strap 92. The other bottom flaps of outer shell 80 will still be in position adjacent their respective panels of outer shell 80. The spout 34 will be seen to have been pulled from the openings 62, 72 and 83 into a generally horizontal position, lying on the flap 87*f*. There is shown attached to the screw threaded fitting 35 a correspondingly threaded fitting 95 which is attached to a discharge hose 96, the threaded cap 38 having been removed. With the discharge hose 96 coupled to the spout 34, the strap 46 will then having been cut, as by a knife inserted into and accommodated by the notch 45 in the compression block 44. The compression block 44 will then be removed, and the hose 96 pulled in order to remove the reverse folds from the spout 34, thereby providing a passage for the fluent material from within the bag 30 to be discharged through the now unrestricted spout 34 and the discharge hose 96.

Figure 8:
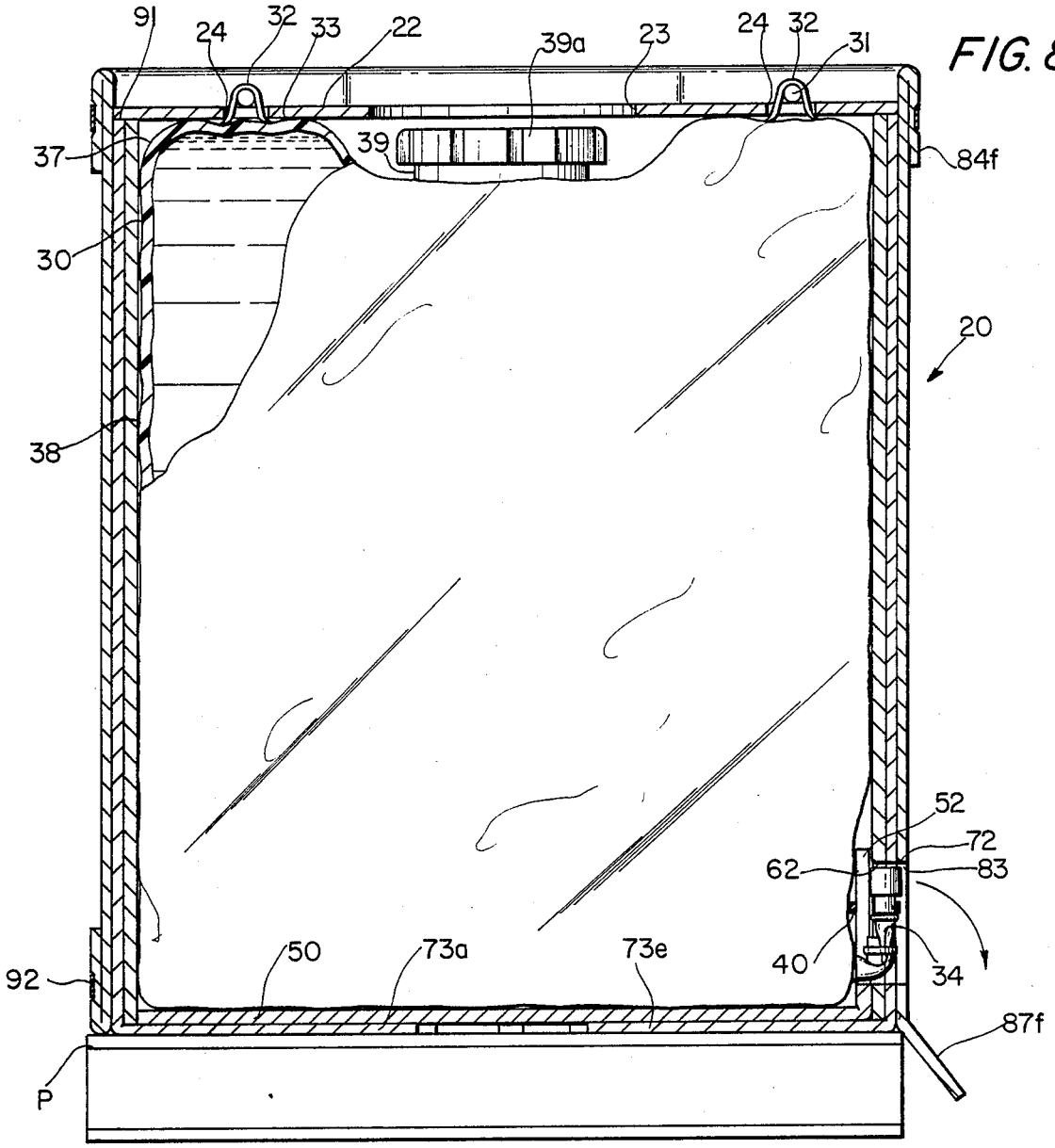
FIG. 8 is a cross-sectional view taken on the line 8—8 of FIG. 7.

Referring to FIG. 8, there is shown the container 20 on the pallet P, with the bottom flap 87*f* open as in FIG. 7. The spout 34 is shown in position, still attached to the flap 52 by the elastic band 40. The spout 34 is shown located in the opening formed by the openings 62, 72 and 83. As will be understood, the elastic band 40 may be readily severed and the spout 34 is then swung downwardly as indicated by the arrow to provide access to the strap 46, for severing, as above indicated.

Figure 9:
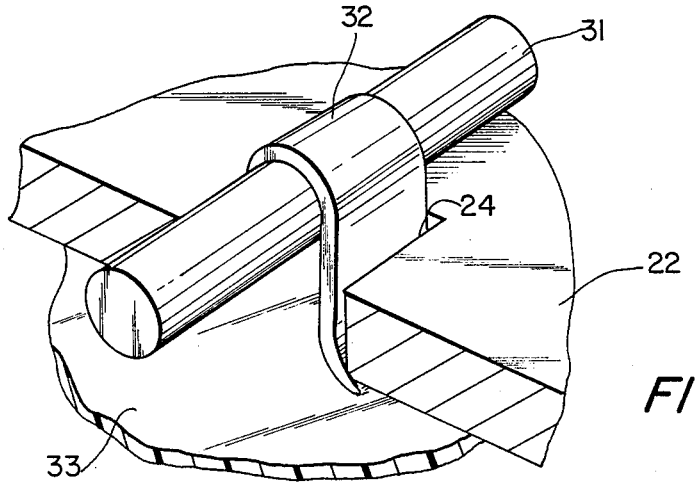
FIG. 9 is a perspective view, with parts in section, of a support for the bag of the container.

The edges of octagonal top plate 22 adjoin the inner surface of octagonal shell 80 above ledge 91, and to plate 22 has slits 24 therein, through which the suspension straps 32 extend. As shown in FIGS. 8 and 9, the suspension straps 32 are each secured to the top 3 of the bag 30, as by adhesion or welding, in a conventional manner. The straps 32 are located on the top 33 of bag 30 at locations which are inwardly of the edge or juncture 37 between the top 33 and the side 38 of the bag 30. The straps 32 are also located outwardly of a fitting 39 which is secured in conventional manner to the top 33 of bag 30, the fitting 39 being shown provided with a threaded closure cap 39*a*. There are shown in FIGS. 8 and 9 keepers 31 which will have been passed through the straps 32, engaging the upper surface of the top plate 22. By this construction, the straps 32 will be prevented from passing downwardly through the slots 34 in top plate 22, and serve to suspend the bag 30 within the liners 60 and 70. The top plate 22 functions as a beam for carrying at least some of the weight of bag 30, and is supported at its perimeter by the ledge 91. During filling, with the cap 37 removed, and the bottom plate 50 resting on the bottom formed by the flaps 73, the empty bag will be suspended by the straps 32 and keepers 31 from top plate 22: twisting of the bag 30, as might occur under the forces from the entering fluent material, is prevented, and the occurrence of the creases in the bag 30 is also prevented. Creases have been found to be a source of leakage, the bag failing at a crease, and twisting has also been found to be a cause of creases, as well as causing a diminution in the available capacity for storage. The adjoining relationship of the edges of octagonal top plate 22 with the inner surfaces of octagonal shell 80 resists twisting of bag 30, and adds strength to the top part of container 20 after it is filled.

Figure 10:
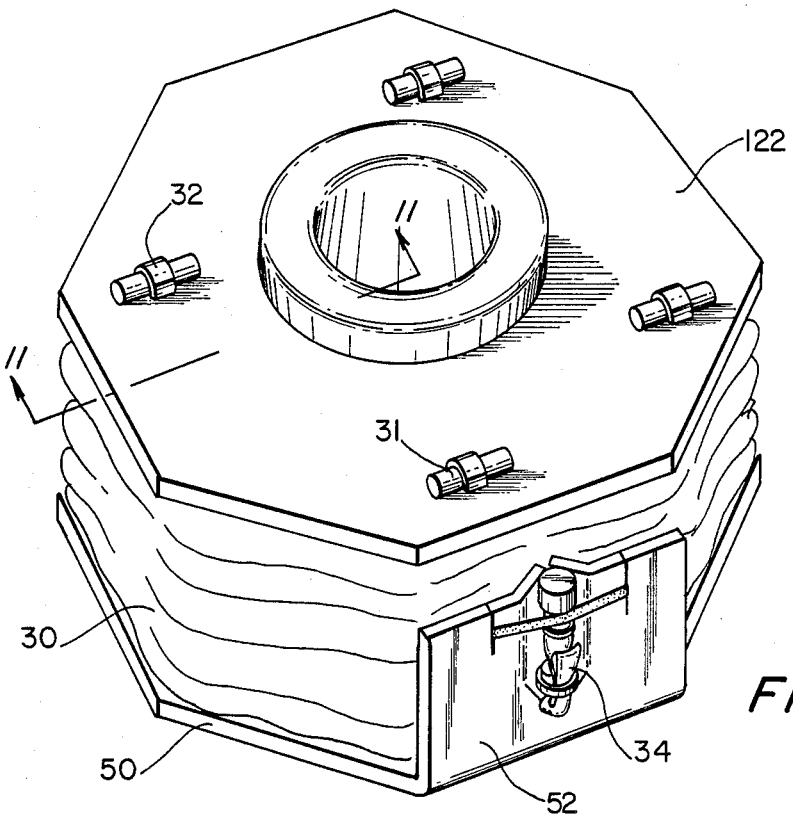
FIG. 10 is a perspective view of an alternate embodiment of a bag and related components of a container in accordance with the present invention.
Figure 11:
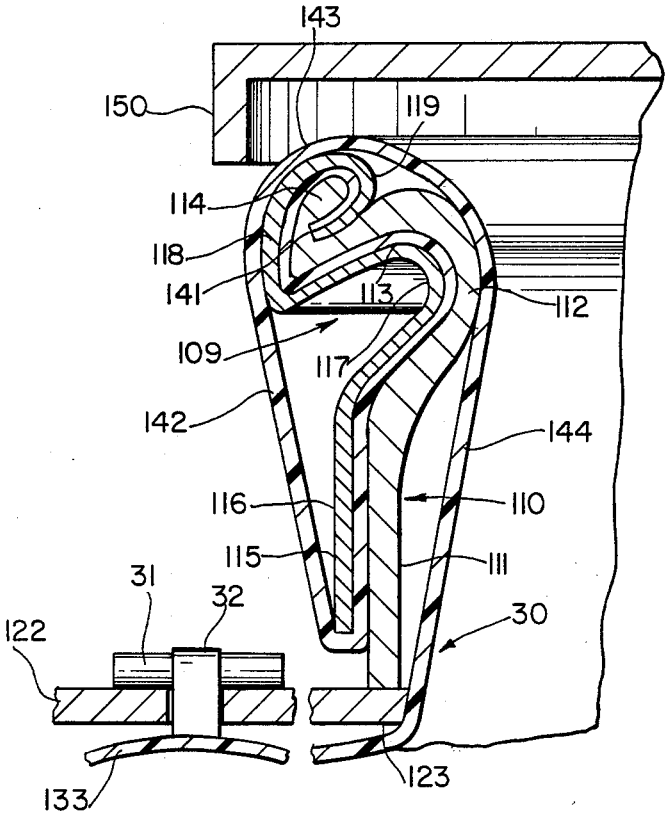
FIG. 11 is a cross-sectional view taken on the line 11—11 of FIG. 10 and including a cap, broken away.

There are shown in FIGS. 10 and 11 an alternate embodiment of portions of a container in accordance with the present invention in which the mouth of the bag 30 is united with a ring which is of relatively large diameter, for rapid filling of the bag. In FIG. 10 there is shown a top plate 122, which is substantially the same as the top plate 22 except that the opening 123 therein (see FIG. 11) is substantially larger than the opening 23. Opening 123 and the ring in effect define the diameter of the filling opening of the bag 30, and in practice may be approximately fifteen inches in diameter: this contrasts with an internal diameter of slightly less than six inches of the fitting 39. The subassembly shown in FIG. 10 comprises, also, the bag 30 with spout 34 and the bottom plate 50 with flap 52, which are constructed as in the embodiment shown in FIG. 1. Further, the straps 32 and keepers 31 are substantially the same as those in the embodiment of FIGS. 1–9.

Referring to FIG. 11, there is shown a holder for the bag 30 attached to the mouth thereof: as shown, a portion of a composite ring 109 has in transverse cross section a pressed fiber hanger ring 110 with a relatively straight vertically extending portion 111, surmounted by a transversely curvilinear configuration comprised of a first inwardly convex portion 112, connected to a generally inwardly concave portion 113, surmounted by a bulbous portion 114. A metal holder ring 115 has a similar vertical portion 116 which is parallel to the portion 111 of the fiber hanger ring 110. The metal holder ring 115 has a mating inwardly convex portion 117 which generally mates with and has the same configuration as the convex portion 112 of the fiber hanger ring 110. The metal holder ring 115 also has an inwardly facing concave portion 118, and a final generally outwardly facing concave portion 119. Laminated between the pressed fiber ring 110 and the metal holder ring 115 is the upper or mouth portion of the bag 30, the terminus 141 of which lies under the bulbous portion 114 and adjacent the terminus of the metal holder ring 115. The opening through the composite ring 109 is provided by the inner surface of innermost ring 110 which is spaced from the mouth of bag 30 by the thickness of ring 110, thereby providing a large, unrestricted opening into bag 30.

The laminating and forming of the fiber hanger ring 110, the terminal portion of the bag 30, and the metal holder ring 115 is effected by conventional equipment, such as is used to form the transversely configured top and encircling ring of a conventional fiber drum. The mouth portion of the bag 30 will be seen to be laminated between the fiber hanger ring 110 and the metal holder ring 115, and has a portion 142 extending upwardly from the lower edge of metal holder ring 115, thence over the uppermost curved portion of metal holder ring 115, as shown at 143, and thence extends downwardly at a portion 144 to the central opening 123 in the top plate 122. The bag 30 then spreads out laterally from the throat portion 144, to provide the top 133 of the bag 30, there being provided a plurality of straps 32 and keepers 31, one of each of which is shown in FIG. 11. A conventional cap 150 may be provided to cover the filling opening into the bag 30, which is defined by the throat portion 144, the cap 150 being held in position by a conventional contractible ring (not shown) such as used on fiber drums.

The assembly of the rings 110 and 115, due to the transversely curvilinear and mating configuration thereof, causes the composite ring 109 to be axially fixed relative to each other so that they, together with bag 30, form a unitary separately joined structure which cannot be disassembled or disjoined without destruction of one or the other of the parts thereof. The composite ring 109 will be seen to rest upon the top plate 122, which functions as a beam, as above noted, and the ring 109 will be seen to be peripherally extending and of larger diameter than the opening 123.

There has been provided a container for shipping larger quantities such as three hundred gallons, of fluent material. The container includes a bag impervious to the material to be transported which is supported at the top thereof at locations which are spaced from the filling opening, and uniformly distributed relative thereto, but are inwardly of the edges of the bag. The support for the top of the bag is provided by suspension elements in the form of loops which extend through slots in a beam, formed as a top plate of multi-wall corrugated board, and is therefore of substantial strength. The suspension loops are prevented from downward movement by keepers which pass through them and which engage the top surface of the top plate. The keepers may be simple wooden dowels.

The filling opening of the bag forming a part of the container herein disclosed may be either a conventional threaded fitting with a threaded cap, or is a composite ring comprised of a pair of annular elements, transversely configured to prevent axial movement, and with the mouth portion of the bag laminated between them.

The container herein disclosed has a flexible discharge spout at the bottom, which when prepared for the filling of the bag, is reverse folded about two axially spaced fold lines, providing a portion of triple thickness, against which a compression element is secured by an encircling strap: the encircling element may be a wooden cylinder with an axially extending notch for the admission of the blade of a knife, for severing the strap.

The spout is attached to the flap of a bottom plate to which the bottom of the bag is adhered, the attachment being by an elastic band which encircles a part of the flap and the spout. The wall of the container, at its lower portion, has an opening through it which is occupied by the spout when the bag is filed and ready for shipment, the opening being covered by a flap extending upwardly over it, the flap being held in place during shipment by a strap which encircles a series of flaps at the bottom of the shell of the container.

It will be obvious to one skilled in the art that various changes may be made without departure from the spirit of the invention, and therefore the invention is not limited to that shown in the drawings and described in the specification, but only as indicated in the appended claims.

What is claimed is:

1. A container for non-gaseous fluent material to be transported therein comprising:

an outer wall, a bottom, a top on said outer wall, a bag within said wall for holding non-gaseous fluent material, said bag having an upper portion including a mouth which defines a filling opening in the top of said bag, said bag having substantially the same size and shape as the interior of said container when said bag is filled with fluent material, and means for supporting the mouth of said bag in open position for enabling filling of said bag with non-gaseous fluent material through said open mouth comprising:

a beam, means for supporting said beam transversely of said container wall below the top of said container, an opening in said beam, said bag upper portion extending through said opening, a ring-like holder independent of said beam on the top of said beam, said ring-like holder having an opening larger than said opening in said beam, and means for securing the mouth portion of said bag to said holder without substantially reducing the size of the filling opening defined by said mouth of said bag and said opening of said ring-like holder.

2. The container of claim 1, and means for supporting said bag at locations spaced from said filling opening comprising suspension elements on the top of said bag, and means for engaging said suspension elements.

3. The container of claim 2, said suspension elements comprising loops.

4. The container of claim 2, said supporting means comprising said beam, and means for connecting said suspension elements to said beam.

5. The container of claim 4, said suspension elements comprising loops on said bag.

6. The container of claim 5, said connecting means further comprising slots in said beam, said loops extending through said slots, and keepers extending through said loops and engaging the top of said beam.

7. The container of claim 6, said loops being between said opening and the juncture of the bag top and the bag side.

8. The container of claim 2, said supporting means being substantially evenly distributed about said filling opening.

9. The container of claim 1, said filling opening having a releasable closure therefor.

10. The container of claim 1, wherein said means for supporting said beam comprises a ledge in said container inwardly of the outer wall, said outer wall being polygonal, and said beam having edges adjoining the inner surface of said outer wall.

11. The container of claim 1, said holder comprising plural ring-like elements, said mouth of said bag being between and held by said ring-like elements.

12. A container for fluent material comprising:

an outer wall, an empty bag in said container having an open mouth adjacent the top thereof, and means for supporting the mouth of said empty bag and for preventing said bag from being pulled into said container during filling of said bag comprising:

(a) a beam having a transverse opening therethrough, (b) means for supporting said beam below said top of said container and transversely of said container wall, (c) hanger means for holding the top of the bag, at least parts of said hanger means being larger than said transverse opening and which are on and supported by said beam, said hanger means having an opening therethrough, (d) the mouth of said bag extending upwardly through said transyerse opening of said beam and engaging said hanger means, (e) means for holding said mouth of said empty bag to said hanger means with said mouth in open position without substantially reducing the size of the filling opening defined by said mouth of said bag and said opening of said hanger means, and (f) cap means for closing said open mouth of said bag, (g) said holding means holding only said bag to said hanger means, whereby said hanger means and said holding means hold open said mouth of said bag prior to and during filling and said cap may close said open mouth of said bag after said bag is filled.

13. The container of claim 12, said hanger means and said holding means comprising a composite ring of plural annular mating elements, said mouth of said bag being between said annular mating elements, and means for inseparably joining said elements and the mouth of said bag.

14. The container of claim 12, said holding means and said hanger means being ring-like elements, and means for inseparably securing the mouth of said bag to said ring-like elements.

15. The container of claim 14, said ring-like elements having mating transversely curvilinear configurations for inseparably joining said bag and said elements, said mouth of said bag being between said mating elements.

16. The container of claim 15, said elements being annular.

17. The container of claim 16, one said annular element being a metal ring and the other being a pressed fiber ring.

18. The container of claim 17, said metal and fiber rings being of multiple curvilinear configuration in transverse cross-section.

19. The container of claim 17, said rings having successive inwardly facing convex and concave portions.

20. A structure for use with a container for holding fluent material comprising:

a bag having a mouth, a composite ring-like member comprising first and second ring-like elements, the mouth of said bag being between said elements, means for inseparably joining said bag and said first and second ring-like elements, said ring-like member and said joining means comprising means for holding the mouth of said bag open and for providing a substantially unrestricted opening into said bag through said ring-like member, said joining means and the mouth of said bag, one said ring-like element being innermost, the inner surface of the innermost ring-like element being spaced from said mouth of said bag between said ring-like elements by the thickness of said innermost ring-like element and defining the opening through said ring-like member.

21. The structure of claim 20, wherein said joining means comprises said elements being of mating axially curvilinear configuration.

22. The structure of claim 20, wherein one said element is metal and the other said element is pressed fiber.

23. The structure of claim 10, said structure being free of means for closing the mouth of said bag.

24. The structure of claim 20, said means for inseparably joining said elements comprising portions of said elements and mouth being at different distances from the axis of said ring-like member.

25. The structure of claim 24, wherein said portions of said elements are curvilinear.

26. A structure for use with a container for holding fluent material comprising:

a bag having a mouth, a composite ring-like member comprising first and second ring-like elements, the mouth of said bag being between said elements, and means for inseparably joining said bag and said first and second ring-like elements comprising successive inwardly and outwardly convex and concave portions of said ring-like elements.

27. The structure of claim 26 wherein one said element is metal and the other said element is pressed fiber.

28. An article of manufacture for use with a container for shipping and storing large quantities of fluent material, said container having sides, a bottom and a beam supported adjacent the top of the container, said beam having an opening therethrough, said article comprising an empty, collapsed bag of flexible fluid impervious material having an open mouth, a ring-like member larger than said opening, and means for inseparably joining the mouth of said bag to said ring-like member, said ring-like member and said joining means comprising means for holding the mouth of said bag open and for providing a substantially unrestricted opening into said bag through said ring-like member, said joining means and said mouth of said bag.

29. The article of manufacture of claim 28, said ring-like member comprising a first ring-like element of metal and a second ring-like element of compressed fiber, said mouth of said bag being between said ring-like elements, and said elements being of mating convex and concave portions.

30. The article of manufacture of claim 28, said article being free of means for closing the mouth of said bag.

31. THe article of manufacture of claim 28, wherein said member comprises a pair of ring-like elements, the mouth of said bag being between said elements, said joining means comprising means for securing together said elements and said bag.

32. THe article of manufacture of claim 31, said securing means comprising portions of said elements and said mouth being at different distances from the axis of said ring-like member.

33. The article of manufacture of claim 32, said securing means comprising successive inward and outward mating convex and concave portions.

34. A container for receiving fluent material comprising:

an outer wall, an empty bag in said container having an open mouth at the top thereof for receiving fluent material, and means for supporting said bag in said container and for holding open the mouth thereof during filling of fluent material into said bag through said mouth comprising:

(a) a beam having a transverse opening therethrough, (b) means for supporting said beam below the top of said outer wall transversely of said outer wall, (c) the mouth of said bag extending upwardly through said opening, and (d) means attached to said empty bag for holding said mouth of said bag in open position, said holding means being outwardly of said opening in said beam and supported on said beam, said holding means and said mouth of said bag providing an opening into said bag for filling thereof and said container being free of means for closing the mouth of said empty bag.

35. The container for receiving fluent material as set forth in claim 34, said holding means being separate from said beam.

36. The container for receiving fluent material as set forth in claim 34, and further comprising means for inseparably joining said bag and said holding means.

37. The container for non-gaseous fluent material to be transported therein comprising:

an outer polygonal wall, a top closure, a bottom, a bag within said wall for holding non-gaseous fluent material, said bag having an upper portion comprising means for defining a filling opening in the top of said bag, said bag having substantially the same size and shape as the interior of said container when said bag is filled with fluent material, a beam of the same polygonal shape as said outer wall and having edges adjoining the interior surface of said outer polygonal wall, means for supporting said beam transversely of said container wall below the top of said container, an opening in said beam, said bag extending through said opening in said beam, means including said beam for supporting the upper portion of said bag with said filling opening adjacent said opening in said beam, and said top closure element on said polygonal outer wall.

38. The container of claim 37, said means for supporting said beam comprising a ledge inwardly of the outer wall.

* * * * *